US010639219B2

(12) United States Patent
Schmidt et al.

(10) Patent No.: US 10,639,219 B2
(45) Date of Patent: May 5, 2020

(54) INTERLOCK FOR LIFT OUTER ROLL STOP

(71) Applicant: Westinghouse Air Brake Technologies Corporation, Wilmerding, PA (US)

(72) Inventors: Timothy R. Schmidt, Wheeling, IL (US); Lluno Cervera, Panorama City, CA (US); Paul W. Debski, Orland Park, IL (US); Karl J. Kobel, Wildwood, IL (US); Benjamin R. Satkiewicz, Evanston, IL (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 16/227,288

(22) Filed: Dec. 20, 2018

(65) Prior Publication Data

US 2020/0093661 A1 Mar. 26, 2020

Related U.S. Application Data

(60) Provisional application No. 62/733,865, filed on Sep. 20, 2018.

(51) Int. Cl.
*A61G 3/06* (2006.01)
*A61G 3/08* (2006.01)

(52) U.S. Cl.
CPC ..... *A61G 3/0808* (2013.01); *A61G 3/062* (2013.01)

(58) Field of Classification Search
None
See application file for complete search history.

(56) References Cited

U.S. PATENT DOCUMENTS 3,893,697 A * 7/1975 Blitz ..... B60P 1/4442 303/6.1
4,176,999 A * 12/1979 Thorley ..... B60P 1/4421 105/447
4,251,179 A * 2/1981 Thorley ..... B60P 1/4421 414/545
4,977,981 A * 12/1990 Paquin ..... A61G 3/063 187/200
5,636,399 A * 6/1997 Tremblay ..... A61G 3/061 14/71.1
7,500,818 B1 * 3/2009 Johnson ..... A61G 3/06 414/546
7,798,761 B2 * 9/2010 Goodrich ..... A61G 3/061 318/468
9,456,940 B2 * 10/2016 DeLeo ..... A61G 3/062
2006/0051191 A1 * 3/2006 Dupuy ..... A60P 1/4557 414/522

* cited by examiner

*Primary Examiner* — Mark C Hageman
(74) *Attorney, Agent, or Firm* — Christopher R. Carroll; The Small Patent Law Group LLC

(57) ABSTRACT

An outer roll stop for a wheelchair lift includes a base having a leading end, a trailing end, a top surface, and a bottom surface positioned opposite from the top surface, a top plate secured to the base, with the top plate moveable relative to the base, and an interlock assembly comprising a sensor positioned between the top plate and the base, with the sensor having a first state and a second state. The sensor moving from the first state to the second state when an object is positioned on the top plate. The sensor is configured to detect when an object is positioned on the top plate prior to motion of the outer roll stop.

18 Claims, 7 Drawing Sheets

INTERLOCK FOR LIFT OUTER ROLL STOP

CROSS-REFERENCE TO RELATED APPLICATION

This application claims priority to U.S. Provisional Application Ser. No. 62/733,865, filed Sep. 20, 2018, which is hereby incorporated by reference in its entirety.

BACKGROUND OF THE INVENTION

Field of the Invention

The present invention relates generally to a wheelchair lift outer roll stop and, in particular, to an interlock for a wheelchair lift outer roll stop.

Description of Related Art

Access systems and wheelchair lift arrangements are provided to permit access, entry, exit, ingress, egress, and the like, from a variety of structures and environments. For example, many vehicles are fitted or configured to interact with a wheelchair lift arrangement to allow a wheelchair (or other limited mobility) user to enter and exit the vehicle.

Many wheelchair lift arrangements include a roll stop on the outer end, i.e., an outer roll stop, to prevent a wheeled mobility assistance device from rolling off of the lift during use. The outer roll stop typically includes a safety interlock to prevent the lift from lifting over a small specified height when a standard test wheelchair has at least one wheel on the outer roll stop. A conventional roll stop interlock functions by remaining in a deployed or lowered position during operation of the lift until a predetermined height of the lift is reached and then the roll stop will rotate upward to the stop or raised position. When the lift begins motion, if the roll stop either does not stow, or if the roll stop is moved opposite the direction of stowing, such action indicates a load on the roll stop and the interlock is triggered to prevent further motion of the lift.

SUMMARY OF THE INVENTION

In one aspect, an outer roll stop for a wheelchair lift includes a base having a leading end, a trailing end, a top surface, and a bottom surface positioned opposite from the top surface, a top plate secured to the base, with the top plate moveable relative to the base, and an interlock assembly including a sensor positioned between the top plate and the base. The sensor has a first state and a second state, with the sensor transitioning from the first state to the second state when an object is positioned on the top plate. The sensor is configured to detect when an object is positioned on the top plate prior to motion of the outer roll stop.

The sensor may be a sensitized strip having first and second conductive elements, with the first and second conductive elements configured to engage each other when the sensitized strip is compressed. The sensor may be a plurality of sensitized strips arranged parallel to each other, with each of the plurality of sensitized strips including a lead connected to an adjacent lead of an adjacent sensitized strip. A control circuit may be configured to monitor the sensor and prevent movement of a wheelchair lift when the sensor is in the second state, with the control circuit connected to an end lead of one of the sensitized strips. The sensor may be in the first state when the top plate is in a first position, and the second may be in the second state when the top plate is in a second position spaced from the first position of the top plate. The top plate may be biased to the first position by a biasing arrangement. The biasing arrangement may include one or more compression springs. The biasing arrangement may be a linear spring positioned parallel to the sensitized strip. The linear spring may be a linear wave spring or an elastomer strip.

The top plate may include at least one spacer received by an opening defined by the base, with the at least one spacer moving within the opening of the base when the top plate moves between the first and second positions, and where the spacer includes an abutment that engages the base when the top plate is in the first position. The abutment may be a fastener secured to the spacer, with a head of the fastener engaging the base when the top plate is in the first position.

The top plate may be metal. The outer roll stop may further include a flange positioned at the trailing end of the base, with the flange defining a gap between the base and the flange and the gap configured to allow egress of water and debris during movement of the roll stop. The flange comprising an extension portion that engages the base when the top plate is in the first position.

The sensor may further include a resistor, with the control circuit configured to detect possible disconnection or damage to the plurality of sensitized strips based on a predetermined resistance value threshold.

In a further aspect, a wheelchair lift includes a lifting platform, a lift mechanism secured to the lifting platform, an inner roll stop secured to the lifting platform, and an outer roll stop secured to the lifting platform, with the lift mechanism configured to move each of the lifting platform, the inner roll stop, and the outer roll stop between a raised position and a lowered position. The outer roll stop includes a base having a leading end, a trailing end, a top surface, and a bottom surface positioned opposite from the top surface, a top plate secured to the base, with the top plate moveable relative to the base, and an interlock assembly having a sensor positioned between the top plate and the base. The sensor having a first state and a second state. The sensor transitioning from the first state to the second state when an object is positioned on the top plate. The sensor is configured to detect when an object is positioned on the top plate prior to motion of the outer roll stop.

The outer roll stop may be in the lowered position when the lifting platform is in the lowered position, and the outer roll stop may be in the raised position when the lifting platform is in the raised position. The inner roll stop may be in the raised position when the lifting platform is in the lowered position, and the inner roll stop may be in the lowered position when the lifting platform is in the raised position. The sensor comprises a sensitized strip having first and second conductive elements. The first and second conductive elements are configured to engage each other when the sensitized strip is compressed. The sensor may be in the first state when the top plate is in a first position, and the second may be in the second state when the top plate is in a second position spaced from the first position of the top plate.

These and other features and characteristics of the present invention, as well as the methods of operation and functions of the related elements of structures, and the combination of parts and economies of manufacture will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
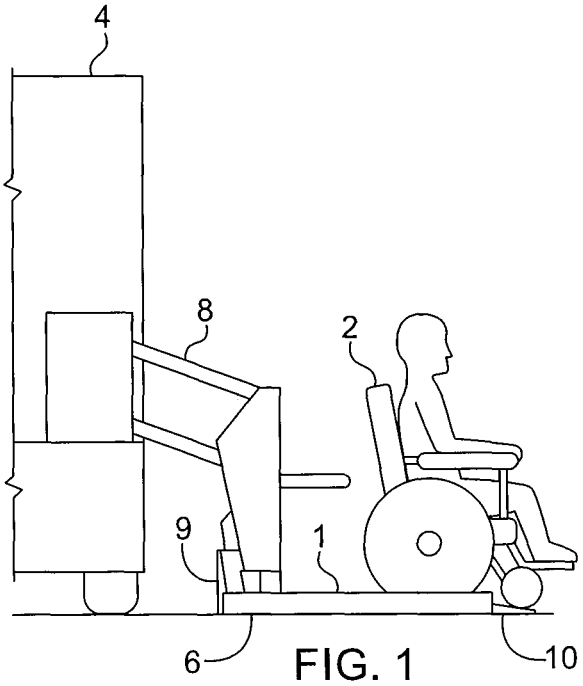
FIG. 1 is a schematic view of a wheelchair lift according to one aspect of the present invention, showing the wheelchair lift in a lowered position.
Figure 2:
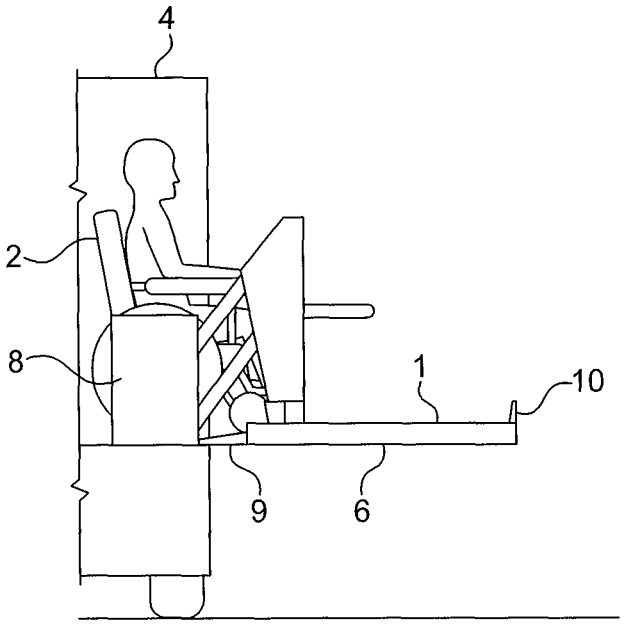
FIG. 2 is a schematic view of the wheelchair lift of FIG. 1, showing the wheelchair lift in a raised position.
Figure 3:
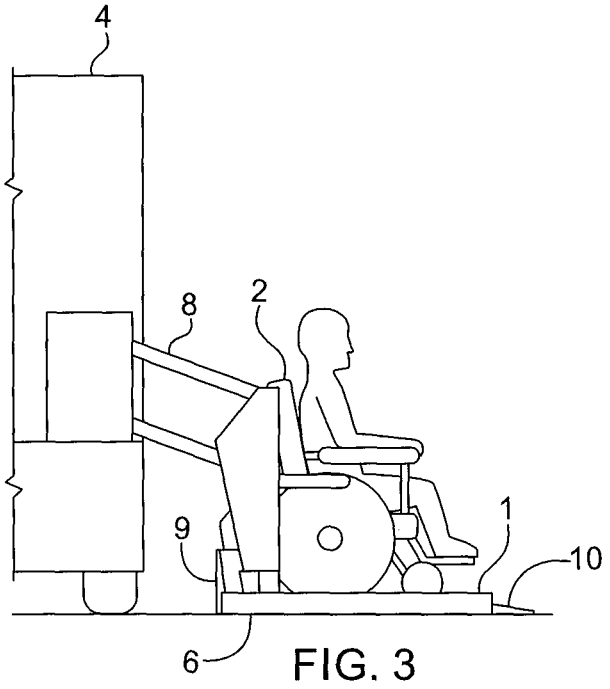
FIG. 3 is a schematic view of the wheelchair lift of FIG. 1, showing the wheelchair lift in a lowered position and egress of an occupant utilized a wheeled mobility aid.
Figure 4:
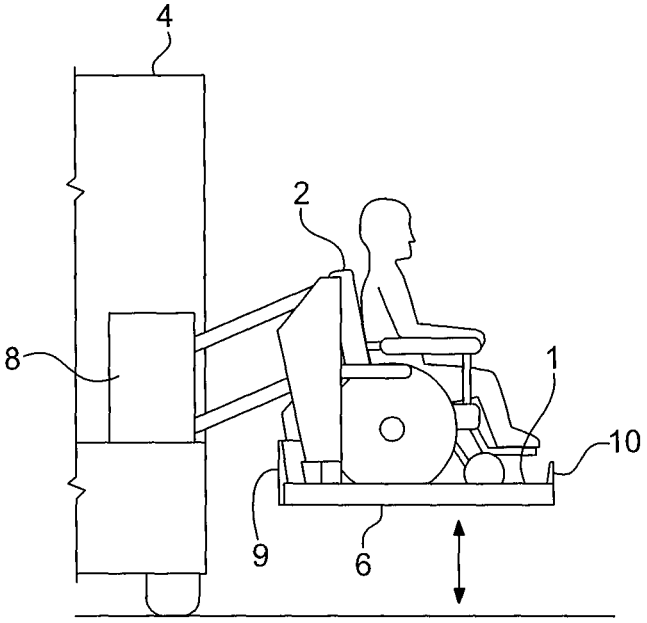
FIG. 4 is a schematic view of the wheelchair lift of FIG. 1, showing the wheelchair lift in an intermediate position.
Figure 5:
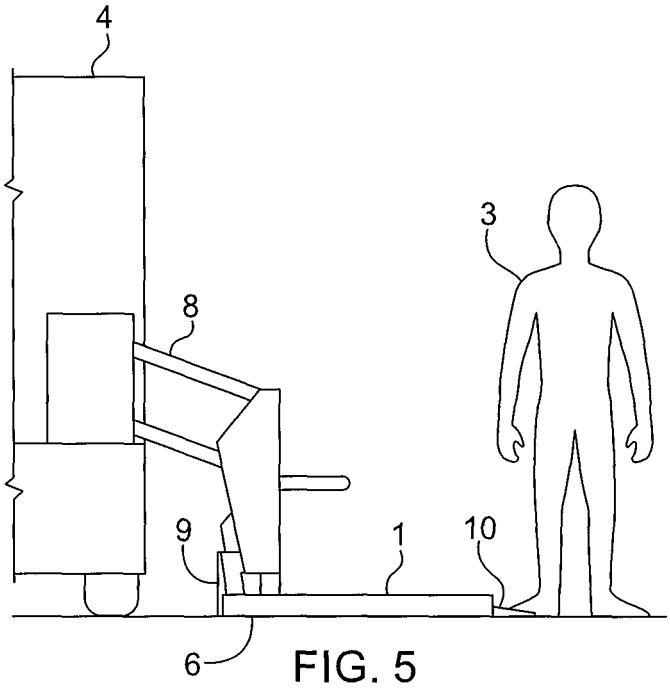
FIG. 5 is a schematic view of the wheelchair lift of FIG. 1, showing the wheelchair lift in a lowered position and egress of a standing occupant.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

With reference to FIGS. 1-11, a wheelchair lift 1 according to one aspect of the present application is shown. The wheelchair lift 1 is utilized to lift a mobility assistance device 2 or standing passenger 3 into a vehicle 4. The wheel chair lift 1 includes a lifting platform 6, a lift mechanism 8 secured to the lifting platform 6, an inner roll stop 9 secured to the lifting platform 6, and an outer roll stop 10 secured to the lifting platform 6. The lift mechanism 8 is configured to move each of the lifting platform 6, the inner roll stop 9, and the outer roll stop 10 between a raised position and a lower position. Per federal safety standards, the wheelchair lift 1 is equipped with the outer roll stop 10 on the outside and the inner roll stop 9 on the vehicle side. When the lifting platform 6 is at ground level, or the lowered position, the outer roll stop 10 is rotated to a lowered position and acts as a ramp to assist in the transition to the ground. When the wheelchair lift 1 starts the lifting process, the outer roll stop 10 automatically rotates to a raised position at a height specified by safety standards to protect the occupant. When the lifting platform 6 is in the fully raised position, the inner roll stop 9 is rotated to a lowered position and may be used as a bridge plate to bridge the gap between the lifting platform 6 and the vehicle 4 thereby allowing the occupant to easily move into the vehicle interior. As the lifting platform 6 is lowered from the fully raised position, the inner roll stop 9 is automatically rotated to a raised position to prevent collision with the vehicle 4 and to prevent the occupant from moving off of the rear of the lifting platform 6. The lift mechanism 8 may be any suitable powered or manual lift arrangement. For example, the lift mechanism 8 may include one or more electric motors and a mechanical linkage operatively connected to the electric motor, which cooperate to move the lifting platform 6 and inner and outer roll stops 9, 10 between the various positions.

Referring to FIGS. 1-5, when the lifting platform is in the lowered position (FIG. 1), the inner roll stop 9 is in the raised position and the outer roll stop 10 is in the lowered position. When the lifting platform 6 is in the raised position (FIG. 2), the inner roll stop 9 is in the lowered position and the outer roll stop 10 is in the raised position. When the lifting platform 6 is in an intermediate position (FIG. 4), between the raised position and lowered position, the inner roll stop 9 and the outer roll stop 10 are both in the raised position.

Referring to FIGS. 6-11, the outer roll stop 10 includes a base 12 having a leading end 14, a trailing end 16, a top surface 18, and a bottom surface 20 positioned opposite from the top surface 18, a top plate 22 secured to the base 12, with the top plate 22 moveable relative to the base 12, and an interlock assembly 24. The interlock assembly 24 includes a sensor 26 positioned between the top plate 22 and the base 12, with the sensor 26 having a first state and a second state. The sensor 26 transitions from the first state to the second state when an object engages the top plate 22. The sensor 26 is configured to detect when an object is positioned on or engaged with the top plate 22 prior to motion of the outer roll stop 10. The object may be a mobility assistance device 2, a standing passenger 3, or other type of object. In conventional roll stop interlock devices, the lift begins moving prior to detection of an object on the roll stop or interference with the roll stop, which can create an unsafe condition if an occupant is standing on the roll stop and unprepared for movement of the lift. By detecting an object on the roll stop 10 prior to any movement of the wheelchair lift 1, the safety of the occupant is ensured.

In one aspect, the sensor 26 is a sensitized strip having first and second conductive elements 28, 30 enclosed in a compressible body 32, with the first and second conductive elements 28, 30 configured to engage each other when the body 32 of the sensitized strip is compressed. The compressible body 32 may be formed from an elastomeric material, although other suitable materials may be utilized. In particular, the sensor 26 may include a plurality of sensitized strips arranged parallel to each other, with each of the plurality of sensitized strips having a lead 34 connected to an adjacent lead 34 of an adjacent sensitized strip. A control circuit 36 is connected to the sensor 26 and is configured to monitor the sensor 26 and prevent movement of the wheelchair lift 1 when the sensor 26 is in the second state. The control circuit 36 may be connected to an end lead 38 of one of the sensitized strips. In a further aspect, a resistor of a known value may be provided at the end of a final link. Using this resistor, the control circuit 36 can monitor the sensitized strips and, if the resistance increases above a predetermined threshold, detect possible disconnection or damage to the sensitized strips and prevent movement of the wheelchair lift 1 except with a manual override. The sensor 26 is in the first state when the top plate 22 is in a first position and is in the second state when the top plate 22 is in a second position spaced from the first position of the top plate 22.

Figure 7:
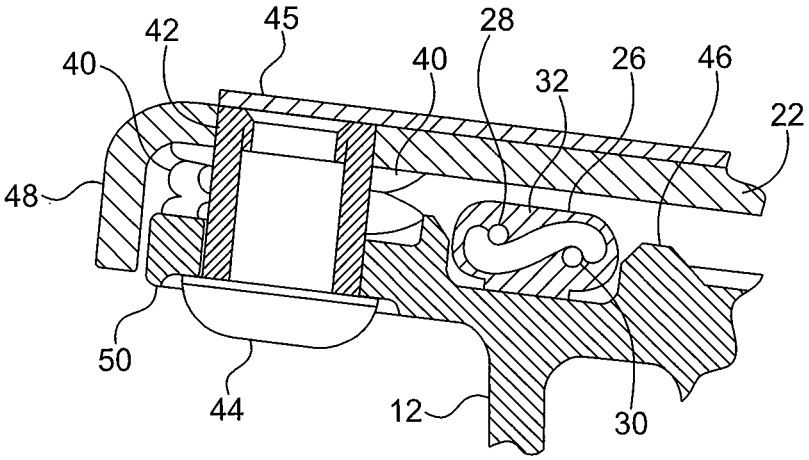
FIG. 7 is a partial cross-sectional view of the outer roll stop of FIG. 6, showing a first position of a top plate.

Referring to FIG. 7, the top plate 22 is biased to the first position by a biasing arrangement 40. In one aspect, the biasing arrangement 40 includes one or more compression springs biasing the top plate 22 away from the base 12 of the outer roll stop 10. The biasing arrangement 40 prevents the elastomer of the sensitized strips from taking a set and improves reliability of the outer roll stop 10. In other aspects, the biasing arrangement 40 may be a linear spring positioned parallel to the sensitized strip. The linear spring may be a linear wave spring or an elastomer strip, although other suitable configurations may be utilized.

Figure 8:
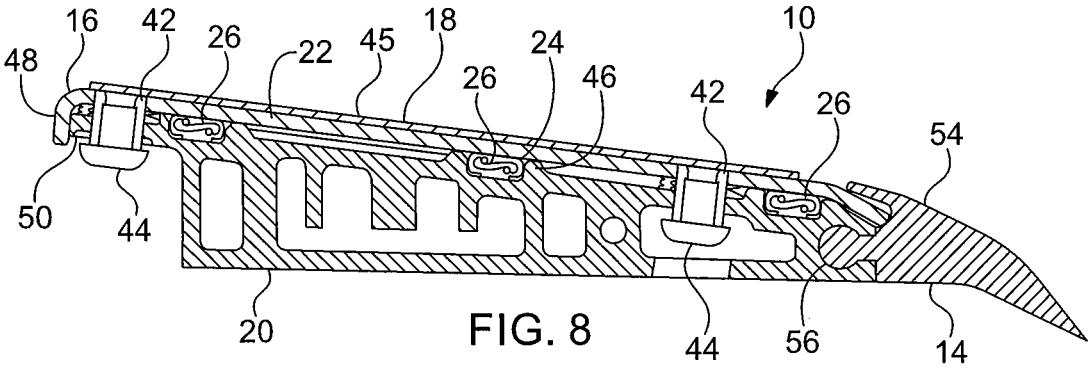
FIG. 8 is a cross-sectional view of the outer roll stop of FIG. 6, showing a second position of a top plate.
Figure 9:
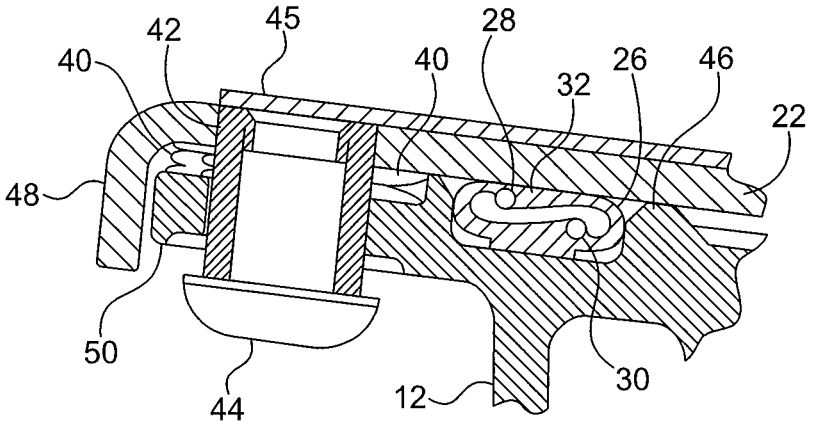
FIG. 9 is a partial cross-sectional view of the outer roll stop of FIG. 6, showing a second position of a top plate.

Referring to FIGS. 6-9, the top plate 22 includes a plurality of spacers 42 received by respective openings defined by the base 12, with the plurality of spacers 42 moving within the opening of the base 12 when the top plate 22 moves between the first position (FIG. 7) and the second position (FIG. 9). The spacers 42 each include an abutment 44 that engages the base 12 when the top plate 22 is in the first position. In one aspect, the abutment 44 is a fastener secured to the spacer 42, with a head of the fastener engaging the base 12 when the top plate 22 is in the first position. The fastener may be a screw, rivet, or any other suitable member. In a further aspect, the abutment 44 is formed integrally with the spacer 42.

In one aspect, the top plate 22 is formed from metal, such as stainless steel, although other suitable materials may be utilized. Providing the top plate 22 from metal advantageously forces the entire top plate 22 to move when a load is placed on the top plate 22 and ensure the top plate 22 is sensitive across the whole roll stop surface. Conventional membrane sensors often have a "dead zone" at the perimeter. The use of a metal top plate 22 also protects the sensitized strips from damage and creates a more robust and damage resistant design. An anti-slip coating or surface 45 may be applied to the top surface of the top plate 22 to improve traction for occupants. In a further aspect, the top plate 22 may be manufactured from a metal extrusion or molded plastic with a snap-in feature to secure the top plate 22 to the base 12.

In one aspect, the base 12 of the outer roll stop 10 is manufactured from an aluminum extrusion, although other suitable materials and manufacturing arrangements may be utilized. The base 12 includes a plurality of protrusions 46 on the top surface 18 of the base 12, which prevent an object bearing on the top plate 22 from over-compressing the sensor 26 or compressible body 32.

Referring to FIGS. 7 and 9, a flange 48 is positioned at the trailing end 16 of the base 12. The flange 48 defines a gap 50 between the base 12 and the flange 48. The gap 50 is configured to allow egress of water and debris during movement of the roll stop 10 to the raised position. The gap 50 reduces the likelihood of faults due to foreign object intrusion which would cause false readings.

Figure 10:
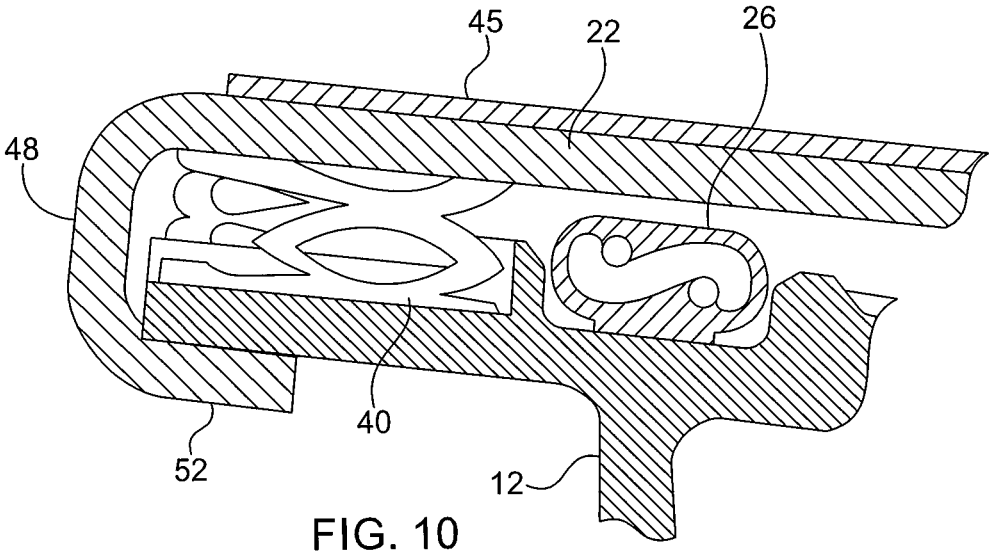
FIG. 10 is a partial cross-sectional view of an outer roll stop according to a further aspect of the present invention.
Figure 11:
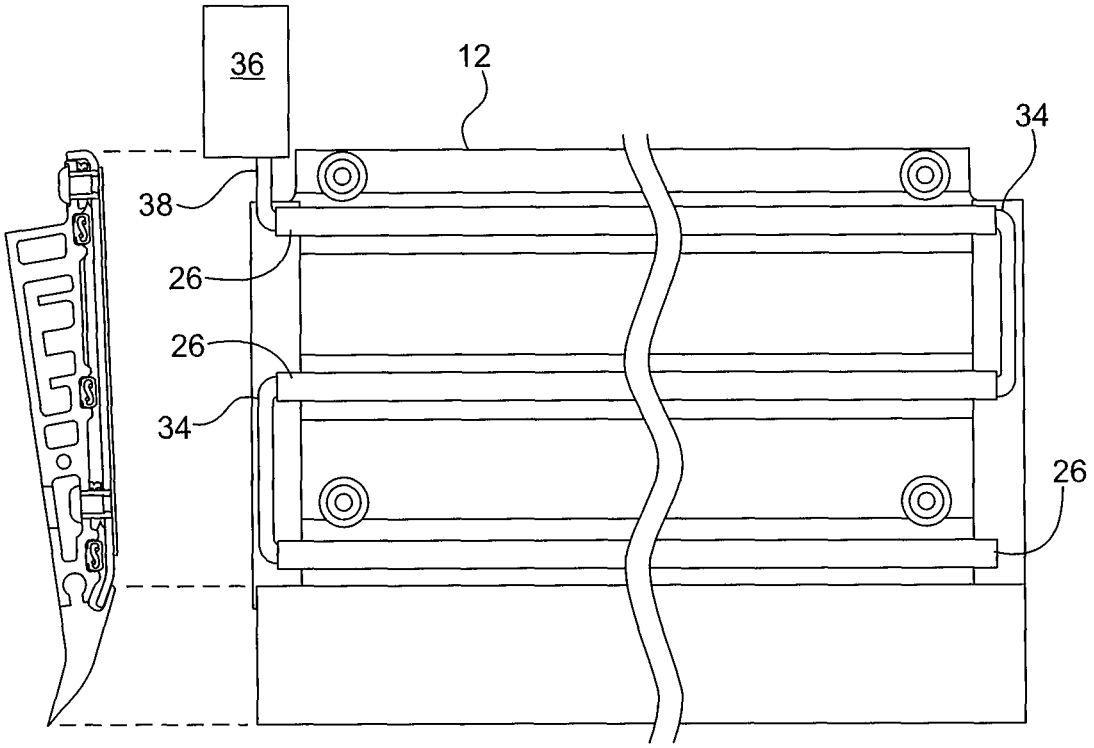
FIG. 11 is a top view of the outer roll stop of FIG. 6, showing the outer roll stop with the top plate omitted for clarity.

Referring to FIG. 10, in a further aspect, the flange 48 includes an extension portion 52 that engages the base 12 when the top plate 22 is in the first position. Rather than providing the spacers 42 and abutments 44, the extension portion 52 secures the top plate 22 to the base 12 while still allowing movement of the top plate 22. Although not shown, the leading edge of the top plate 22 may also be bent fully around the base 12 and used to secure the top plate 22 to the base 12 instead of the spacers 42 and abutments 44.

Figure 6:
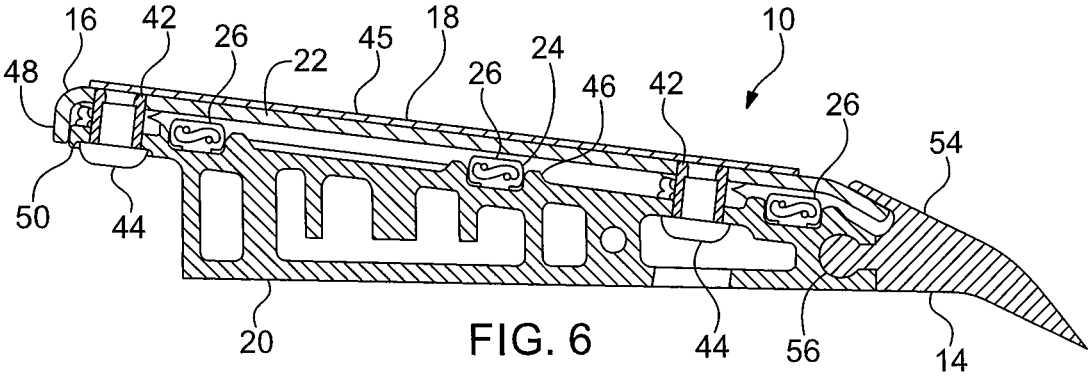
FIG. 6 is a cross-sectional view of an outer roll stop according to one aspect of the present invention, showing a first position of a top plate.

Referring to FIGS. 6 and 8, a tip portion 54 is mounted in, a slot or recess 56 of the base 12 of the outer roll stop 10. The tip portion 54 provides a conforming lead-in surface to assist the user in rolling up onto the outer roll stop 10 when in the lowered position. The tip portion 54 may be an elastomer extrusion, although other suitable materials and manufacturing arrangements may be utilized. The tip portion 54 may also be utilized to secure the top plate 22 to the base 12.

In certain aspects, a compliant strip (not shown) is placed around the perimeter of the gap 50 between top plate 22 and the base 12. The compliant strip may act as a complete or partial seal to block foreign matter from entering the gap 50. The compliant strip or the linear springs, discussed above, may include adhesive on top and bottom surfaces that is used to secure the top plate 22 to the base 12 instead of the spacers 42 and abutments 44. The compliant strip allows the top plate 22 to move and compress the sensor 26 while preventing the plate 22 from moving away from the strip or in a lateral direction.

It is to be understood that the invention may assume various alternative variations and step sequences, except where expressly specified to the contrary. It is also to be understood that the specific devices and processes illustrated in the attached drawings, and described in the specification, are simply exemplary embodiments of the invention. Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope thereof. For example, it is to be understood that the present invention contemplates that, to the extent possible, one or more features of any embodiment can be combined with one or more features of any other embodiment.

The invention claimed is:

1. An outer roll stop for a lift comprising:

a base having a leading end, a trailing end, a top surface, and a bottom surface positioned opposite from the top surface;

a top plate secured to the base, the top plate moveable relative to the base; and an interlock assembly comprising a sensor positioned between the top plate and the base, the sensor having a first state and a second state, the sensor transitioning from the first state to the second state when an object is positioned on the top plate, wherein the sensor is configured to detect when an object is positioned on the top plate prior to motion of the outer roll stop, wherein the sensor is in the first state when the top plate is in a first position, and wherein the sensor is in the second state when the top plate is in a second position spaced from the first position of the top plate, the top plate biased to the first position by a biasing arrangement, wherein the top plate comprises at least one spacer received by an opening defined by the base, the at least one spacer moving within the opening of the base when the top plate moves between the first and second positions, and the spacer comprises an abutment that engages the base when the top plate is in the first position.

2. The outer roll stop of claim 1, wherein the sensor comprises a sensitized strip having first and second conductive elements, the first and second conductive elements are configured to engage each other when the sensitized strip is compressed.

3. The outer roll stop of claim 2, wherein the sensor comprises a plurality of sensitized strips arranged parallel to each other, each of the sensitized strips comprising a lead connected to an adjacent lead of an adjacent sensitized strip.

4. The outer roll stop of claim 3, further comprising a control circuit configured to monitor the sensor and prevent movement of the lift when the sensor is in the second state, the control circuit connected to an end lead of one of the sensitized strips.

5. The outer roll stop of claim 1, further comprising a control circuit connected to the sensor, the control circuit configured to monitor the sensor and prevent movement of the lift when the sensor is in the second state.

6. The outer roll stop of claim 1, wherein the biasing arrangement comprises one or more compression springs.

7. The outer roll stop of claim 1, wherein the sensor comprises a sensitized strip having first and second conductive elements, the first and second conductive elements are configured to engage each other when the sensitized strip is compressed, and wherein the biasing arrangement comprises a linear spring positioned parallel to the sensitized strip.

8. The outer roll stop of claim 7, wherein the linear spring comprises a linear wave spring or an elastomer strip.

9. The outer roll stop of claim 1, wherein the abutment comprises a fastener secured to the spacer, a head of the fastener engaging the base when the top plate is in the first position.

10. The outer roll stop of claim 1, wherein the top plate is metal.

11. The outer roll stop of claim 1, further comprising a flange positioned at the trailing end of the base, the flange defining a gap between the base and the flange, the gap configured to allow egress of water and debris during movement of the roll stop.

12. The outer roll stop of claim 1, further comprising a flange positioned at the trailing end of the base, the flange comprising an extension portion that engages the base when the top plate is in the first position.

13. The outer roll stop of claim 1, wherein the sensor comprises sensitized strips arranged parallel to each other, each of the sensitized strips comprising a lead connected to an adjacent lead of an adjacent sensitized strip, the outer roll stop further comprising a control circuit configured to monitor the sensor and prevent movement of the lift when the sensor is in the second state, the control circuit connected to an end lead of one of the sensitized strips, and wherein the sensor further comprises a resistor, the control circuit configured to detect possible disconnection or damage to the sensitized strips based on a predetermined resistance value threshold.

14. A lift comprising:

a lifting platform;

a lift mechanism secured to the lifting platform;

an inner roll stop secured to the lifting platform;

an outer roll stop secured to the lifting platform, the lift mechanism configured to move each of the lifting platform, the inner roll stop, and the outer roll stop between a raised position and a lowered position, the outer roll stop comprising:

a base having a leading end, a trailing end, a top surface, and a bottom surface positioned opposite from the top surface;

a top plate secured to the base, the top plate moveable relative to the base, the top plate having at least one spacer received by an opening defined by the base, the at least one spacer in the top plate moving within the opening of the base when the top plate moves between first and second positions, the spacer including an abutment that engages the base when the top plate is in the first position; and an interlock assembly comprising a sensor positioned between the top plate and the base, the sensor having a first state and a second state, the sensor transitioning from the first state to the second state when an object is positioned on the top plate, wherein the sensor is configured to detect when an object is positioned on the top plate prior to motion of the outer roll stop.

15. The lift of claim 14, wherein the outer roll stop is in the lowered position when the lifting platform is in the lowered position, and wherein the outer roll stop is in the raised position when the lifting platform is in the raised position.

16. The lift of claim 15, wherein the inner roll stop is in the raised position when the lifting platform is in the lowered position, and wherein the inner roll stop is in the lowered position when the lifting platform is in the raised position.

17. The lift of claim 14, wherein the sensor comprises a sensitized strip having first and second conductive elements, the first and second conductive elements are configured to engage each other when the sensitized strip is compressed.

18. The lift of claim 14, wherein the sensor is in the first state when the top plate is in the first position, and wherein the sensor is in the second state when the top plate is in the second position spaced from the first position of the top plate.

* * * * *